US005660097A

United States Patent [19]

Nomura et al.

[11] Patent Number: 5,660,097

[45] Date of Patent: Aug. 26, 1997

[54] HINGE BALL FOR VARIABLE CAPACITY WOBBLE PLATE COMPRESSORS AND HARDENING COIL FOR HINGE BALL

[75] Inventors: Hiroshi Nomura; Kazuo Eitai; Minoru Kanaizuka; Hiroyuki Ishida, all of Kounan-machi, Japan

[73] Assignee: Zexel Corporation, Tokyo, Japan

[21] Appl. No.: 512,112

[22] Filed: Aug. 7, 1995

[30] Foreign Application Priority Data

Aug. 11, 1994 [JP] Japan ..... 6-210360

[51] Int. Cl.[6] ..... F01B 3/02

[52] U.S. Cl. ..... 92/12.2; 91/505; 219/644; 219/674

[58] Field of Search ..... 92/12.1, 12.2; 91/504, 505, 506; 417/269; 219/644, 674, 672

[56] References Cited

U.S. PATENT DOCUMENTS

| | | | |
|---|---|---|---|
| 2,182,819 | 12/1939 | Pisarev | 219/674 X |
| 2,182,820 | 12/1939 | Pisarev | 219/674 X |
| 2,214,390 | 9/1940 | Wahlmark | 417/269 X |
| 2,397,629 | 4/1946 | Stevens | 219/644 |
| 4,934,253 | 6/1990 | Berthold et al. | 91/506 |
| 5,051,067 | 9/1991 | Terauchi | 92/12.2 X |
| 5,252,032 | 10/1993 | Iwanami et al. | 92/12.2 X |
| 5,498,140 | 3/1996 | Kawaguchi et al. | 92/12.2 X |

FOREIGN PATENT DOCUMENTS

| | | | |
|---|---|---|---|
| 3-986 | 1/1991 | Japan . | |
| 3-9087 | 1/1991 | Japan . | |
| 90/02247 | 3/1990 | WIPO | 91/505 |

*Primary Examiner*—F. Daniel Lopez

*Attorney, Agent, or Firm*—Frishauf, Holtz, Goodman, Langer & Chick

[57] ABSTRACT

A hinge ball for a variable capacity wobble plate compressor includes a central through hole 27 for permitting a shaft 5 to loosely extend therethrough, and an outer peripheral wall **9*b* in a convex form for being slidably fit with an inner peripheral wall 43*a* in a concave form of a boss 43 of a drive hub 41 rotatively fitted on the shaft 5. The shaft 5 is higher in hardness than the hardness of the boss 43 of the drive hub 41, and the outer peripheral surface 9*b* in sliding contact with the inner peripheral surface 43*a* of the boss 43 of said drive hub 41 is lower in hardness than the hardness of the shaft 5 and the boss 43 of the drive hub 41 or equal in hardness thereto. The hardness of the inner peripheral wall 9*a* defining the central through hole 27 is made higher than the hardness of the boss 43 of the drive hub 41**.

10 Claims, 7 Drawing Sheets

HINGE BALL FOR VARIABLE CAPACITY WOBBLE PLATE COMPRESSORS AND HARDENING COIL FOR HINGE BALL

BACKGROUND OF THE INVENTION

1. Field of the Invention

This invention relates to a hinge ball for a variable capacity wobble plate compressor and a hardening coil therefor, and more particularly to a hinge ball for a variable capacity wobble plate compressor and a hardening coil therefor, which are capable of reducing wear of sliding portions of component parts to thereby prevent offensive noise from being produce during use thereof.

2. Description of the Prior Art

A conventional variable capacity wobble plate compressor has been proposed e.g. by Japanese Provisional Patent Publication (Kokai) No. 3-986, which is shown in FIG. 7. As shown in the figure, a shaft 505 has a thrust flange 540 rigidly fitted thereon, and a drive hub 541 rotatively mounted thereon via the hinge ball 509. The thrust flange 540 and the drive hub 541 are linked to each other by a link arm 542, whereby the rotation of the shaft 505 is transmitted from the thrust flange 540 to the drive hub 541. A wobble plate 510 is mounted on a boss 543 of the drive hub 541. The wobble plate 510 is linked via a connecting rod 511 to a piston 507. With rotation of the shaft 505, the trust flange 540 and the drive hub 541 rotate in unison with the shaft 505, and as the drive hub 541 rotates, the wobble plate 510 performs wobbling motion about the hinge ball 509. The wobbling motion of the wobble plate 510 is transmitted via the connecting rod 511 to the piston 507, to thereby transform the wobbling motion into a linear reciprocating motion of the piston 507.

As shown in FIG. 8, the hinge ball 509 has a central through hole 527 through which the shaft 505 loosely extends. An inner peripheral surface 509*a* of the hinge ball 509 is in sliding contact with an outer peripheral surface of the shaft 505, and the hinge ball 509 can be moved along the axis of the shaft 505. Further, an outer peripheral surface 509*b* of the hinge ball 509 is in sliding contact with an inner peripheral surface of a boss 543 of the drive hub 541.

The outer peripheral surface 509*b* of the hinge ball 509 is formed in a convex shape, and the inner peripheral surface of the boss 543 is formed in a concave shape, with the outer peripheral surface 509*b* of the hinge ball 509 being fitted in the inner peripheral surface of the boss 543 of the drive hub 541. The inner peripheral surface of the boss 543 of the drive hub is in sliding contact with the outer peripheral surface 509*b* of the hinge ball 509, and the drive hub 541 can be slid on the outer peripheral surface 509*b* of the hinge ball 509.

However, the shaft 505 is made of SMNC21 which has a high hardness. In contrast, the drive hub 541 is made of FCD600 (ductile cast iron) with a low hardness in consideration of the shaping requirements thereof. Therefore, there is a large difference in hardness between the shaft 505 and the drive hub 541. If the hardness of the hinge ball 509 (Fe—C—Cu—Ni-containing sintered material) is made lower than that of the material of the drive hub 541, the inner peripheral surface of the hinge ball 509 wears. Inversely, if the hardness of the hinge ball 509 is made higher than that of the material of the drive hub 541, the inner peripheral surface of the boss 543 of the drive hub 541 wears. In both cases, offensive noise is produced due to wear of members in sliding contact, and there is even a danger that the hinge ball 509 may be broken to lock the compressor.

SUMMARY OF THE INVENTION

It is an object of the invention to provide a hinge ball and a hardening coil therefor for a variable capacity wobble plate compressor, which are capable of reducing wear of a hinge ball and a drive hub, to thereby prevent generation of offensive noise.

To attain the above object, according to a first aspect of the invention, there is provided a hinge ball for a variable capacity wobble plate compressor having a rotational shaft, and a drive hub rotatively mounted on the rotational shaft via the hinge ball, the drive hub having a boss having an inner peripheral surface in a concave form, the hinge ball having a central through hole for permitting the rotational shaft to extend therethrough for free rotation, and an outer peripheral surface in a convex form for being slidably fit with the inner peripheral surface of the boss, wherein the rotational shaft is higher in hardness than the boss of the drive hub, and the outer peripheral surface in a convex form in sliding contact with the inner peripheral surface of the drive hub in a concave form is lower in hardness than sad rotational shaft and the boss of the drive hub or equal in hardness thereto.

The hinge ball according to the first aspect of the invention is characterized in that the hardness of an inner peripheral surface of the hinge ball, which defines the central through hole, is made higher than hardness of the boss of the drive hub.

According to the hinge ball of the first aspect of the invention, it is possible to reduce wear of the inner peripheral surface of the boss of the drive hub, and the inner peripheral surface of the hinge ball in sliding contact with the rotational shaft, which makes it possible to prevent offensive noise from being produced and the compressor from being locked by breakage of the hinge ball, leading to a prolonged life of the compressor.

In a second aspect of the invention, there is provided a hinge ball of the above kind which is characterized in that an anti-wear member in the form of a hollow cylinder which has a hardness higher than the hardness of the inner peripheral surface of the boss of the drive hub in a concave form, is secured to an inner peripheral surface of the hinge ball, which defines the central through hole.

The hinge ball according to the second aspect of the invention provides the same effects as the hinge ball according to the first aspect of the invention.

Preferably, the anti-wear member is in the form of a hollow cylinder which is made from a bearing steel or ceramic, and a green compact is press-molded on an outer peripheral surface of the anti-wear member and sintered.

Preferably, the inner peripheral surface of the hinge ball, which defines the central through hole, is formed with a recess, and a projection is formed on an outer peripheral surface of the anti-wear member for being fitted in the recess.

Further preferably, the anti-wear member is in the form of a hollow cylinder, and the anti-wear member is press fitted in the central hole of the hinge ball.

According to a third aspect of the invention, there is provided a hardening coil for a hinge ball, which is inserted into a central through hole of the hinge ball, and energized for generating heat to harden an inner peripheral surface of the central through hole.

The hardening coil according to the third aspect of the invention is characterized in that the hardening coil is larger in diameter at an intermediate portion thereof than at opposite ends thereof.

The above and other objects, features and advantages of the present invention will become more apparent from the following description taken in conjunction with the accompanying drawings.

DETAILED DESCRIPTION OF THE PREFERRED EMBODIMENTS

Now, the invention will now be described with reference to drawings showing preferred embodiments thereof.

Figure 1:
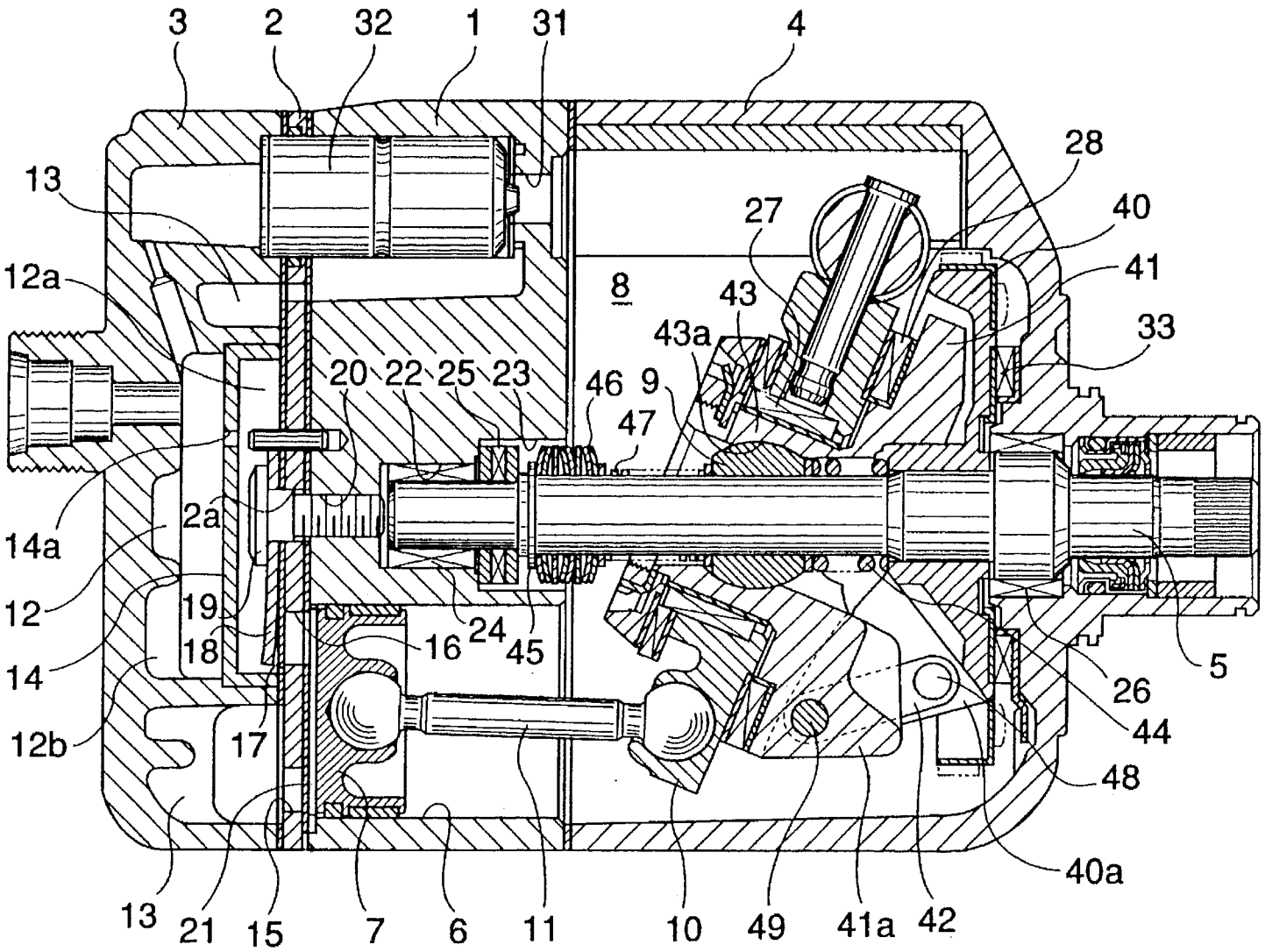
FIG. 1 is a longitudinal cross-sectional view showing a variable capacity wobble plate compressor incorporating a hinge ball according to a first embodiment of the invention.

Referring first to FIG. 1, there is shown a variable capacity wobble plate compressor equipped with a hinge ball according to a first embodiment of the invention. The compressor is comprised of a cylinder block 1, a rear head 3 rigidly fixed to one end face of the cylinder block 1 via a valve plate 2, and a front head 4 rigidly fixed to the other end face of the cylinder block 1.

The cylinder block 1 is formed with a plurality of cylinder bores which extend longitudinally at predetermined circumferentially-spaced intervals around a shaft (rotational shaft) 5. Each cylinder bore 6 has a piston 7 slidably received therein.

The front head 4 has a crankcase 8 formed therein, in which a wobble plate 10 is received for wobbling motion about a hinge ball 9 fitted on the shaft 5, in a manner interlocked with rotation of the shaft 5.

The rear head 3 is formed therein with a discharge pressure chamber 12 and a suction chamber 13 formed around the discharge pressure chamber 12. The discharge pressure chamber 12 is divided by a partition 14 into discharge spaces **12*a*, 12*b* which are communicated with each other via at least one restriction hole 14*a***.

The valve plate 2 is formed with outlet ports 16 which communicates respective cylinder bores 6 with the discharge pressure chamber **12*a*, and inlet ports 15 which communicates respective cylinder bores 6 with the suction chamber 13, both at respective predetermined circumferentially-spaced intervals. Each outlet port 16 is caused to open and close by a delivery valve 17 which is fixed to one end face of the valve plate 2 on the rear head side together with a valve retainer 18 by a bolt 19. The bolt 19 is screwed into a screw hole 20 formed in the cylinder block 1 via a central hole 2*a* formed through the valve plate 2. The inlet port 15 is opened and-closed by a suction valve 21 which is arranged between the valve plate 2 and the cylinder block 1**.

The screw hole 20, a small diameter hole 22, and a larger diameter hole 23 are formed in the center of the cylinder block 1 along the longitudinal axis thereof such that they are communicated with each other. In the small diameter hole 22, a radial bearing 24 is received, and in the large diameter hole 23, a thrust bearing 25 is received. The radial bearing 24 and the thrust bearing 25 rotatively support a rear head-side end of the shaft 5, and a radial bearing 26 arranged in the front head 4 rotatively supports a front head-side end of the shaft 5.

Further, the cylinder block 1 is formed with a communication passage 31 communicating the suction chamber 13 with the crankcase 8. A pressure control valve 32 is provided in an intermediate portion of the communication passage 31 for controlling pressure within the suction chamber 13 and the pressure within the crankcase 8.

Further, the shaft 5 has a thrust flange 40 rigidly fitted thereon, and a drive hub 41 rotatively mounted thereon via the hinge ball 9. The thrust flange 40 and the drive hub 41 are connected to each other by a link arm 42, whereby the rotation of the shaft 5 is transmitted from the thrust flange 40 to the drive hub 41. Mounted on the drive hub 41 via bearings 27, 28 is the wobble plate 10. With rotation of the shaft 5, the thrust flange 40 and the drive hub 41 rotate in unison with the shaft 5, and as the drive hub 41 rotates, the wobble plate 10 performs wobbling motion about the hinge ball 9. The wobble plate 10 is connected via a connecting rod 11 to the piston 7, whereby the wobbling motion of the wobble plate 10 is transmitted via the connecting rod 11 to the piston 7, to thereby transform the wobbling motion into a linear reciprocating motion of the piston 7.

Figure 2A:
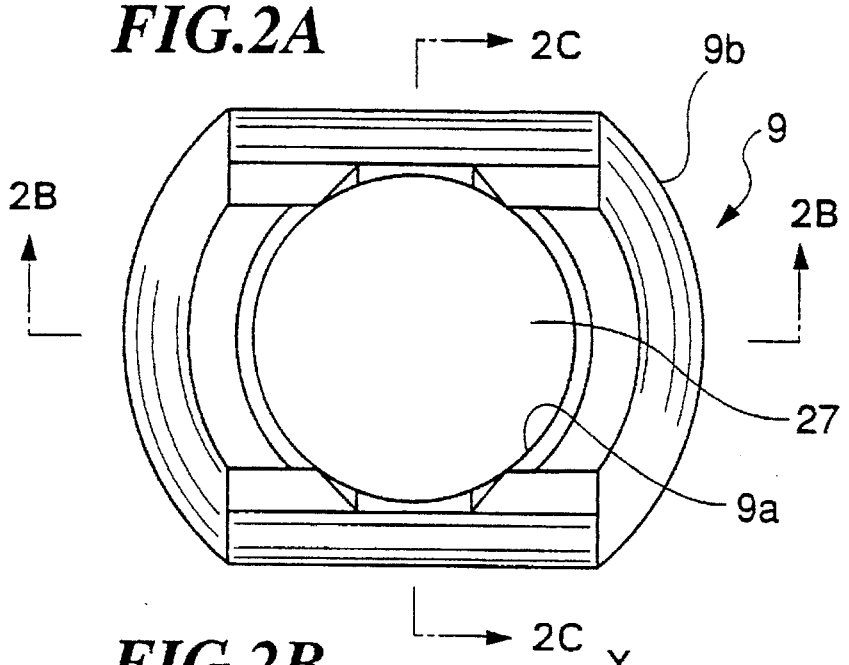
FIGS. 2A to 2C are views which are useful in describing a configuration of the hinge ball and how hardening is conducted thereon.
Figure 2B:
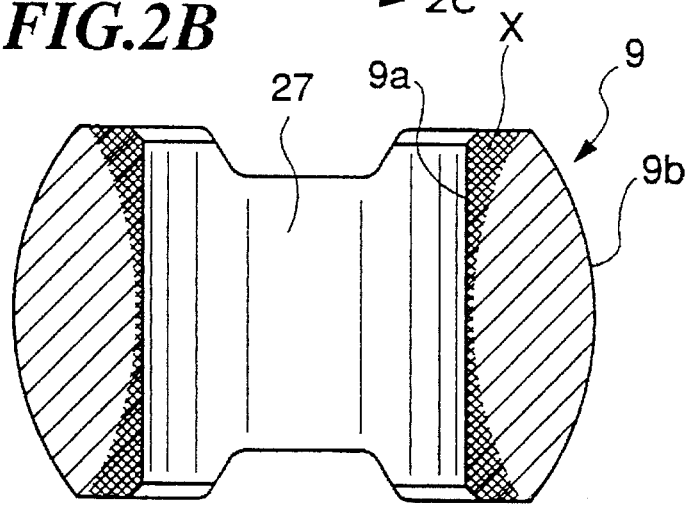
Figure 2C:
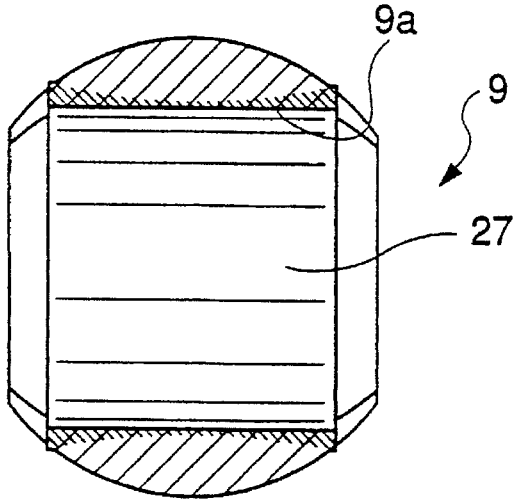

FIG. 2A is a top plan view of the hinge ball 9, FIG. 2B a cross-sectional view taken along lines B—B of FIG. 2A, and FIG. 2C a cross-sectional view taken along lines C—C of FIG. 2A. The hinge ball 9 is formed with a central through hole 27 which is slightly larger in diameter than the diameter of the shaft 5. The hinge ball 9 is fit on the shaft 5 for free rotation, with an inner peripheral surface **9*a* thereof being in sliding contact with an outer peripheral surface of the shaft 5. The hinge ball 9 can be moved along the axis of the shaft 5**.

An outer peripheral surface **9*b* of the hinge ball 9 is formed in a convex shape, and an inner peripheral surface 43*a* of the boss 43 is formed in a concave shape, with the outer peripheral surface 9*b* of the hinge ball 9 being fitted in the inner peripheral surface 43*a* of the boss 43 of the drive hub 41. The inner peripheral surface 43*a* of the boss 43 of the drive hub 41 is in sliding contact with the outer peripheral surface 9*a* of the hinge ball 9, and the drive hub 41 can be slid on the outer peripheral surface 9*b* of the hinge ball 9**.

The shaft 5 is made of SMNC21 which has a high hardness. In contrast, the drive hub 41 is made of FCD600 (ductile cast iron) with a lower hardness than the material of the shaft 5. The hardness of the material of the hinge ball 9 is an Fe—C—Cu—Ni-containing sintered material, which has the lowest hardness of the three members. The relationship in hardness of the materials of the three members is as follows:

Shaft 5>drive hub 41≧hinge ball 9

However, the inner peripheral surface **9*a* of the hinge ball 9 is subjected to induction hardening, as described later, whereby the hardness of the inner peripheral surface 9***a* is made higher than that of the inner peripheral surface 43*a* of the boss 43 of the drive hub 41.

To increase the hardness of the inner peripheral surface 9*a* of the hinge ball 9, a hardening coil 50 is inserted in the central through hole 27 of the hinge ball 9to conduct hardening. As a result, hardened portions X hatched in FIGS. 2B and 2C have increased hardness.

A spring 44 is fit on the shaft 5 between the hinge ball 9 and the thrust flange 40 for urging the hinge ball 9 toward the cylinder block 1. Further, a stopper 45 is formed around a portion of the shaft 5 located within the cylinder block 1, and a plurality of coned disc springs 46 and a coiled spring 47 are fit on the shaft 5 between the stopper 45 and the hinge ball 9 in the mentioned order for urging the hinge ball 9 toward the thrust flange 40.

The thrust flange 40 is supported on the inner wall of the front head 4 via a thrust flange 33. A lower end portion of the thrust flange 40 and a lower end portion of the drive hub 41, as viewed from FIG. 1, are linked to each other by the link arm 42. The link arm 42 has one end thereof rotatively fitted on a pin 48 formed on a projected portion 40*a* of the thrust flange 40 and the other end thereof rotatively fitted on a pin 49 formed on a projected part 41*a* of the drive hub 41.

Next, the operation of the variable capacity wobble plate compressor will be described.

When torque of an engine, not shown, installed on an automotive vehicle is transmitted to the shaft 5, the thrust flange 40 and the drive hub 41 rotate in unison with the shaft 5, whereby the wobble plate 10 performs wobbling motion. The wobbling motion of the wobble plate 10 causes reciprocating motion of the piston 7 in the cylinder bore 6, which causes variation in the capacity of the cylinder bore 6. As the capacity of the cylinder bore 6 varies, refrigerant gas is drawn in, compressed, and delivered. Thus, a high-pressure refrigerant gas is delivered in a volume commensurate with an inclination angle of the wobble plate 10.

As a thermal load decreases, the pressure-regulating valve 32 closes the communication passage 31 to increase the pressure within the crankcase 8, so that the inclination angle of the wobble plate 10 decreases, resulting in a shortened stroke of the piston 7, to reduce the delivery quantity of the refrigerant gas.

As a thermal load increases, the pressure-regulating valve 32 opens the communication passage 31 to decrease the pressure within the crankcase 8, so that, the inclination angle of the wobble plate 10 increases, resulting in a lengthened stroke of the piston 7 to increase the delivery quantity of the compressor.

As described above, the shaft 5, the drive hub 41 and the hinge ball 9 have the relationship in hardness of shaft 5>drive hub 41≧hinge ball 9. When the hinge ball 9 slides on the outer peripheral surface of the shaft 5, the inner peripheral surface 9*a* of the hinge ball 9 and the outer peripheral surface of the shaft 5 are in sliding contact with each other, while when the wobble plate 10 is inclined, the outer peripheral surface 9*b* of the hinge ball 9 and the inner peripheral surface 43*a* of the boss 43 of the drive hub 41 are in sliding contact with each other. Since the hardness of the inner peripheral surface 9*a* of the hinge ball 9 is higher than that of the inner peripheral surface 43*a* of the boss 43 of the drive hub 41, in contrast to the hardness of the outer peripheral surface 9*b* of the hinge ball 9, it is possible to reduce wear of the inner peripheral surface 43*a* of the boss 43 of the drive hub 41 which is in sliding contact with the outer peripheral surface 9*b* of the hinge ball 9, as well as wear of the inner peripheral surface 9*a* of the hinge ball 9 which is in sliding contact with the surface of the shaft 5. Therefore, it is possible to prevent occurrence of offensive noise due to wear of members in sliding contact with each other and locking of the compressor due to breakage of the hinge ball 9.

Figure 4A:
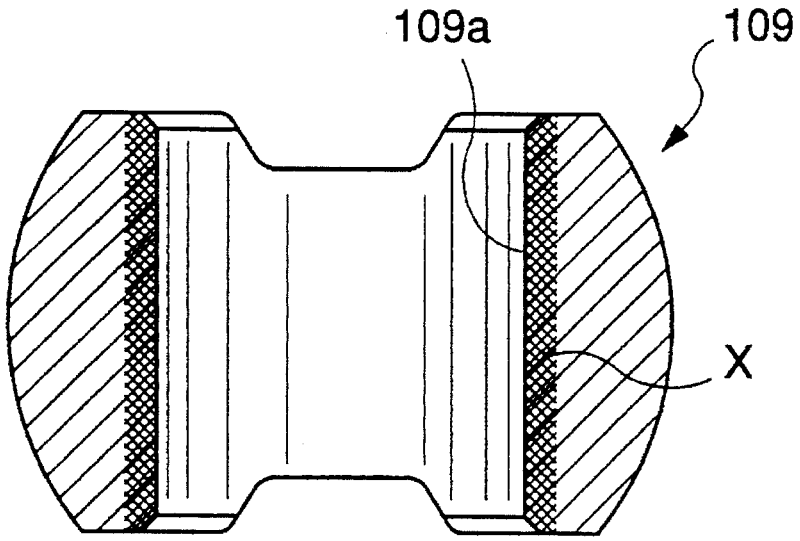
FIGS. 4A and 4B are enlarged cross-sectional views of the hinge ball, which are useful in describing how a hinge ball is hardened according to a second embodiment of the invention.
Figure 4B:
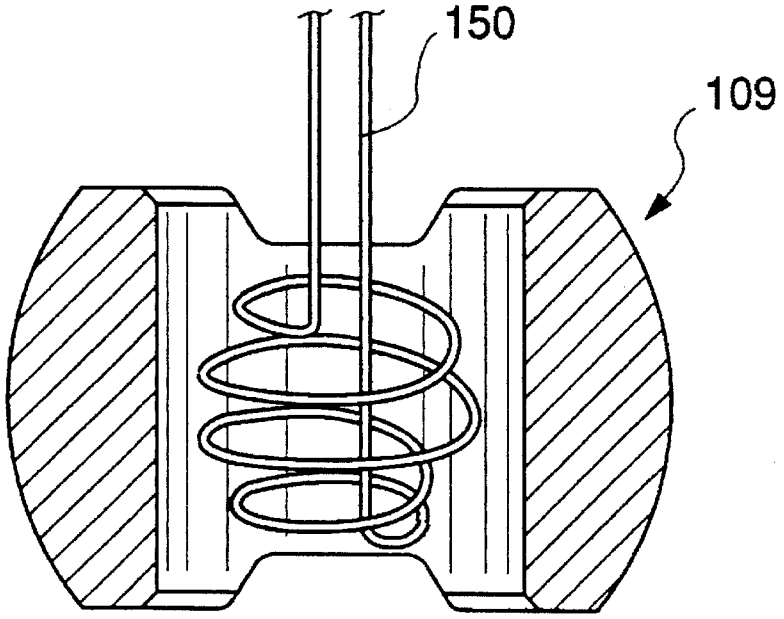

FIG. 4A is an enlarged cross-sectional view of a hinge ball for a variable capacity wobble plate compressor according to a second embodiment of the invention, and FIG. 4B is a cross-sectional view of the hinge ball which illustrates how induction hardening is carried out on the hinge ball. Description of component parts and operation of the second embodiment identical to those of the first embodiment will be omitted.

Figure 3:
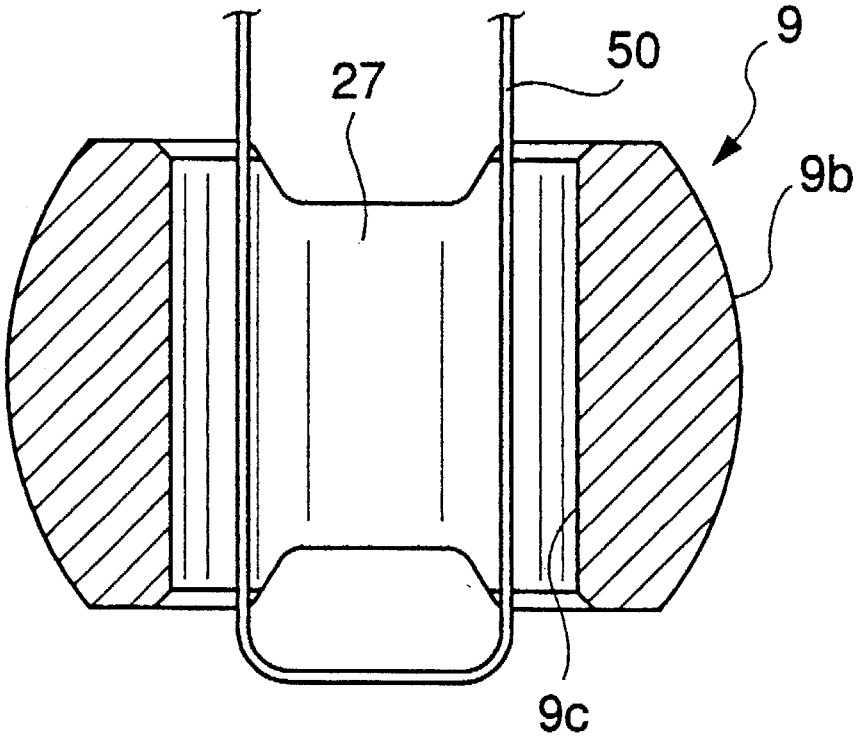
FIG. 3 is an enlarged cross-sectional view of the hinge ball, which is useful in explaining how the FIG. 2 hinge ball is hardened.

In distinction from the first embodiment in which the inner peripheral surface 9*a* of the hinge ball 9 is subjected to induction hardening by the hardening coil 50 as shown in FIG. 3, in the second embodiment, induction hardening is carried out by a hardening coil 150 shown in FIG. 4B. That is, induction hardening is carried out with a special hardening coil 150 in the form of a barrel which is larger in diameter at an intermediate portion than at opposite end portions.

When the hardening coil 50 in the form of a hair pin described in the first embodiment with reference to FIG. 3 is used, the hardened portion X thickly distributes in portions small in thickness, with a partiality. Therefore, even a portion of the outer peripheral surface 9*b* of the hinge ball 9 can be hardened, which can lead to wear of the inner peripheral surface 43*a* of the boss 43 of the dive hub 41. When induction hardening is carried out according to the second embodiment by the hardening coil 150 shown in FIG. 4B, the inner peripheral surface 109*a* of the hinge ball 109 can be uniformly hardened as indicated by cross-hatching in FIG. 4A.

Figure 5:
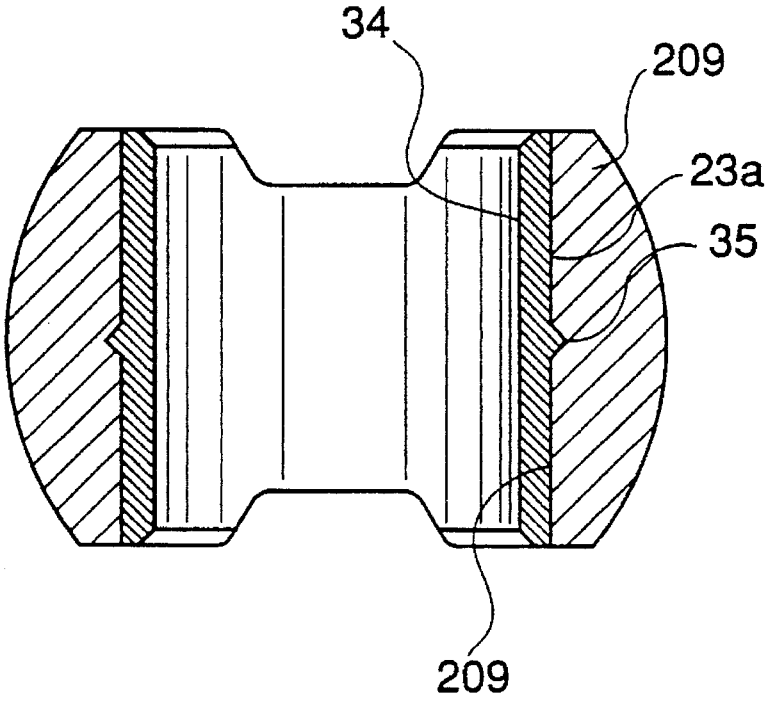
FIG. 5 is an enlarged cross-sectional view of a hinge ball according to a third embodiment of the invention.

FIG. 5 shows an enlarged cross-sectional view of a hinge ball for a variable capacity wobble plate compressor, according to a third embodiment of the invention. Description of component parts and operation of this embodiment identical to those of the first embodiment will be omitted.

In the first and second embodiments, the inner peripheral surfaces 9*a*, 109*a* of the hinge balls 9, 109 are subjected to induction hardening with the hardening coils 50, 150 to make the hardness of the inner peripheral surfaces 9*a*, 109*a* of the hinge balls 9, 109 higher than that of the boss 43 of the drive hub 41. In the third embodiment, however, the inner peripheral surface 209*a* of a hinge ball 209 is provided with an anti-wear member 34 in the form of a hollow cylinder which is higher in hardness than the inner peripheral surface 43*a* of the boss 43 of the drive hub 41. In practice, a green compact is press molded on an outer peripheral surface of the anti-wear member 34 formed of a bearing steel or ceramic, and then sintered. In doing this, a projection 35 for prevention of release is formed in one piece with the outer peripheral surface 34*a* of the anti-wear member 34, the anti-wear member 34 becomes hard to come off the inner peripheral surface 209*a* of the hinge ball 209.

The hinge ball 209 of the third embodiment provides the same effects as provided by the first embodiment.

Figure 6:
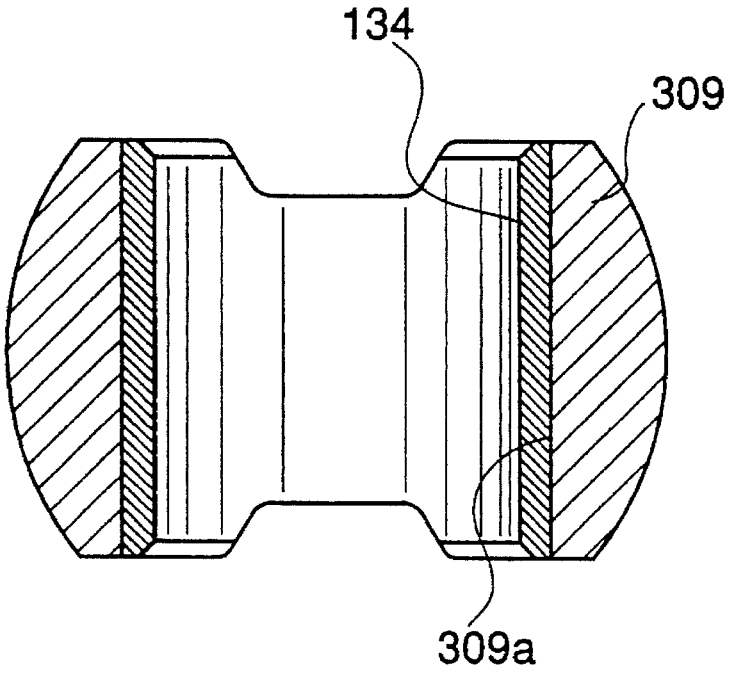
FIG. 6 is an enlarged cross-sectional view of a hinge ball according to a variation of the third embodiment of the invention.
Figure 7:
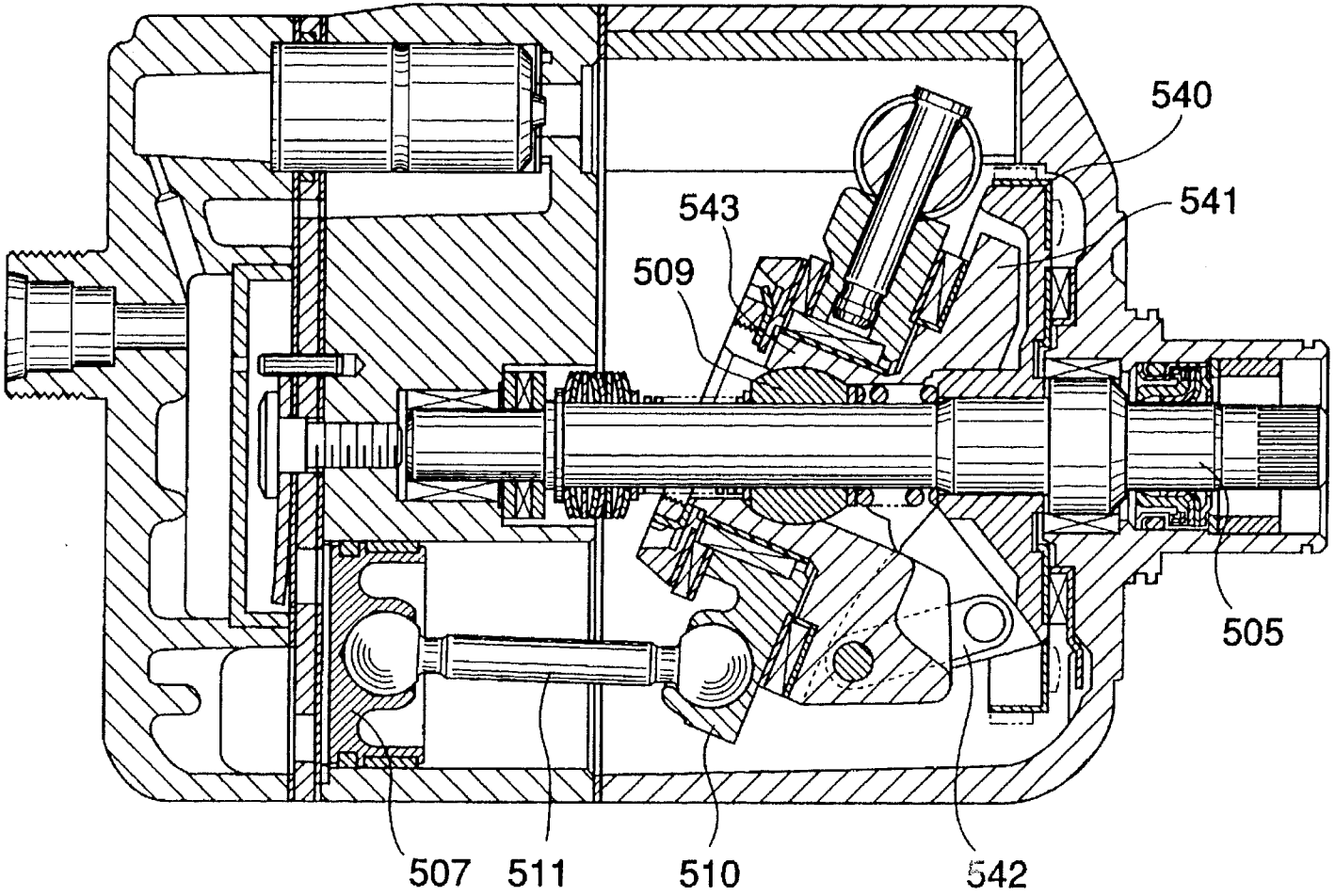
FIG.7 PRIOR ART
FIG. 7 is a longitudinal cross-sectional view showing a conventional variable capacity wobble plate compressor.
Figure 8:
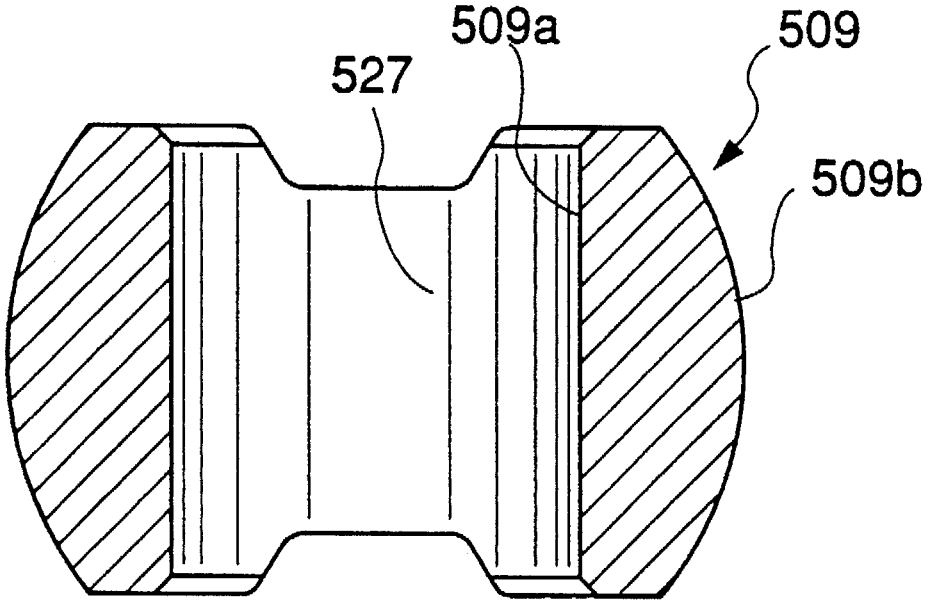
FIG.8 PRIOR ART
FIG. 8 is an enlarged cross-sectional view showing the hinge ball appearing in FIG. 8.

FIG. 6 shows an enlarged cross-sectional view of a variation of the third embodiment of the invention. Description of component parts and operation of this embodiment identical to those of the first embodiment will be omitted.

In this variation, after a hinge ball 309 is sintered for shaping, an anti-wear member 134 prepared in advance is press fit in an inner peripheral surface 309*a* of the hinge ball 309.

The hinge ball 309 according to this variation provides the same effects as obtained by the third embodiment.

What is claimed is:

1. A wobble plate mechanism for a variable capacity wobble plate compressor, comprising:

a rotational shaft, and a drive hub rotatively mounted on said rotational shaft via a hinge ball, said drive hub having a boss having an inner peripheral surface in a concave form, said hinge ball having a central through hole for permitting said rotational shaft to extend therethrough for free rotation, and an outer peripheral surface in a convex form for being slidably fit with said inner peripheral surface of said boss, wherein said rotational shaft is higher in hardness than said boss of said drive hub, and said outer peripheral surface of said hinge ball is lower in hardness than said boss of said drive hub or equal in hardness thereto, and wherein the hardness of an inner peripheral surface of said hinge ball, which defines said central hole, is higher in hardness than said boss of said drive hub.

2. A wobble plate mechanism for a variable capacity wobble plate compressor, comprising:

a rotational shaft, a drive hub rotatively mounted on said rotational shaft, said drive hub having a boss having an inner peripheral surface in a concave form, and a hinge ball having a central through hole for permitting said rotational shaft to loosely extend therethrough, and an outer peripheral surface in a convex form for being slidably fit with said inner peripheral surface of said boss, wherein said rotational shaft is higher in hardness than said boss of said drive hub, and said outer peripheral surface of said hinge ball is lower in hardness than said boss of said drive hub or equal in hardness thereto, and wherein an anti-wear member in the form of a hollow cylinder higher in hardness than said inner peripheral surface of said boss of said drive hub is secured to an inner peripheral surface of said hinge ball, said inner peripheral surface of said hinge ball defining said central through hole of said hinge ball.

3. A wobble plate mechanism according to claim 2, wherein said anti-wear member comprises a bearing steel or ceramic, and wherein a green compact is press-molded on an outer peripheral surface of said anti-wear member and sintered.

4. A wobble plate mechanism according to claim 2, wherein a recess is provided in said inner peripheral surface of said hinge ball, and wherein a projection is formed on an outer peripheral surface of said anti-wear member for being fitted in said recess.

5. A wobble plate mechanism according to claim 2, wherein said anti-wear member is press fitted in said central hole of said hinge ball.

6. A variable capacity wobble plate compressor comprising:

a housing having at least one cylinder bore therein, said at least one cylinder bore having a piston therein, a rotational shaft rotatably mounted in said housing, a hinge ball mounted on said rotational shaft, a drive hub rotatively mounted on said rotational shaft via said hinge ball, and a wobble plate mounted to said drive hub and operatively coupled to said piston of said at least one cylinder bore, said drive hub having a boss having an inner peripheral surface in a concave form, said hinge ball having a central through hole for permitting said rotational shaft to extend therethrough for free rotation, and an outer peripheral surface in a convex form for being slidably fit with said inner peripheral surface of said boss, wherein said rotational shaft is higher in hardness than said boss of said drive hub, and said outer peripheral surface of said hinge ball is lower in hardness than said boss of said drive hub or equal in hardness thereto, and wherein the hardness of an inner peripheral surface of said hinge ball, which defines said central hole, is higher in hardness than said boss of said drive hub.

7. A variable capacity wobble plate compressor comprising:

a housing having at least one cylinder bore therein, said at least one cylinder bore having a piston therein, a rotational shaft rotatably mounted in said housing, a hinge ball mounted on said rotational shaft, a drive hub rotatively mounted on said rotational shaft via said hinge ball, and a wobble plate mounted to said drive hub and operatively coupled to said piston of said at least one cylinder bore, said drive hub having a boss having an inner peripheral surface in a concave form, said hinge ball having a central through hole for permitting said rotational shaft to loosely extend therethrough, and an outer peripheral surface in a convex form for being slidably fit with said inner peripheral surface of said boss, wherein said rotational shaft is higher in hardness than said boss of said drive hub, and said outer-peripheral surface of said hinge ball is lower in hardness than said boss of said drive hub or equal in hardness thereto, and wherein an anti-wear member in the form of a hollow cylinder higher in hardness than said inner peripheral surface of said boss of said drive hub is secured to an inner peripheral surface of said hinge ball, said inner peripheral surface of said hinge ball defining said central through hole of said hinge ball.

8. A variable capacity wobble plate compressor according to claim 7, wherein said anti-wear member comprises a bearing steel or ceramic, and wherein a green compact is press-molded on an outer peripheral surface of said anti-wear member and sintered.

9. A variable capacity wobble plate compressor according to claim 7, wherein a recess is provided in said inner peripheral surface of said hinge ball, and wherein a projection is formed on an outer peripheral surface of said anti-wear member for being fitted in said recess.

10. A variable capacity wobble plate compressor according to claim 7, wherein said anti-wear member is press fitted in said central hole of said hinge ball.

* * * * *